United States Patent [19]

Tamura et al.

[11] Patent Number: 4,896,509

[45] Date of Patent: Jan. 30, 1990

[54] WORKING FLUID FOR RANKINE CYCLE

[75] Inventors: Kohji Tamura, Kawanishi; Hiroshi Kashiwagi, Settsu; Masahiro Noguchi, Osaka, all of Japan

[73] Assignee: Daikin Industries. Ltd., Osaka, Japan

[21] Appl. No.: 266,562

[22] Filed: Nov. 3, 1988

[30] Foreign Application Priority Data

Nov. 6, 1987 [JP] Japan ..... 62-281389

[51] Int. Cl.[4] ..... F01K 25/10

[52] U.S. Cl. ..... 60/671; 60/651

[58] Field of Search ..... 60/651, 671; 252/67

[56] References Cited

U.S. PATENT DOCUMENTS 4,002,573 1/1977 Hutchinson ..... 252/162 X 4,032,467 6/1977 Hutchinson ..... 252/162

4,224,795 9/1980 Stiel et al. ..... 252/67 X 4,224,796 9/1980 Stiel et al. ..... 252/67 X 4,530,773 7/1985 Enjo et al. ..... 252/67

*Primary Examiner*—Allen M. Ostrager

*Attorney, Agent, or Firm*—Larson and Taylor

[57] ABSTRACT

The invention provides a working fluid for Rankine cycle comprising 1,2-dichloro-1,1,2,-trifluoro-ethane; and a process for converting thermal energy into mechanical energy in the Rankine cycle in which a cycle is repeated comprising the steps of vaporizing a working fluid comprising 1,2-dichloro-1,1,2-trifluoroethane with a hot heat source, expanding the resultant vapor in an expansion device, cooling it with a cold heat source to condense and compressing it by a pump.

1 Claim, 2 Drawing Sheets

WORKING FLUID FOR RANKINE CYCLE

This invention relates to novel working fluid for a Rankine cycle.

In Rankine cycle, thermal energy is converted into mechanical energy by repeating a cycle comprising vaporizing a liquid medium (working fluid) with heating, expanding the vapor in an expansion device to produce mechanical energy, and then cooling it to condense and compressing by a pump. Heretofore known as working fluids for the Rankine cycle are chlorofluorohydrocarbons, fluorohydrocarbons, azeotropic compositions thereof and compositions around the azeotropic compositions. Among these, 2,2-dichloro-1,1,1-trifluoroethane (hereinafter referred to as R-123) is generally used, which however has a drawback of being unstable to high-temperature heat source (for example a heat source of about 140° to about 200° C.).

It is an object of the invention to provide a working fluid for a Rankine cycle which is stable at a high-temperature environment.

Other objects and features of the invention will become apparant from the following description.

The present invention provides a working fluid for Rankine cycle comprising 1,2-dichloro-1,1,2-trifluoroethane (hereinafter referred to as **R-123*a***).

The present invention also provides a process for converting thermal energy into mechanical energy in the Rankine cycle in which a cycle is repeated comprising the steps of vaporizing a working fluid comprising 1,2-dichloro-1,1,2-trifluoroethane with hot heat source, expanding the formed vapor in an expansion device, cooling it with a cold heat source to condense and compressing it by a pump.

The working fluid of the invention is more stable at high temperatures than R-123 and capable of increasing the power output at the transmitting end in a Rankine cycle.

The working fluid of the invention comprising **R-123*a* exhibits remarkably improved performances in Rankine cycle in comparison with R-123 which is an isomer of R-123*a*, as seen from the results given in Example and Comparison Examples. The remarkable effects achieved by R-123*a* as working fluid for Rankine cycle is quite unexpected from the known properties of R-123**.

The working fluid of the invention is useful in any type of Rankine cycle devices which convert thermal energy into mechanical energy.

An example of Rankine cycle which utilizes **R-123*a*** as the working fluid will be explained in detail referring to the attached drawings in which.

Figure 1:
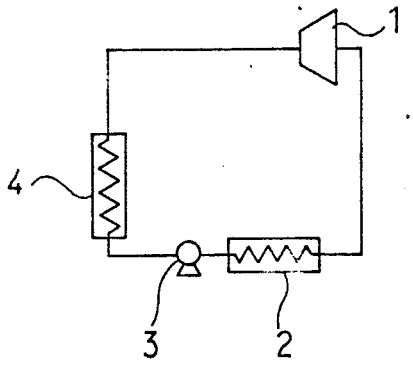
FIG. 1 is a flow sheet of an example of Rankine cycle.

Referring to FIG. 1, a working fluid is heated with a hot heat source such as hot water in an evaporator (4) to produce vapor of high temperature and high pressure. The vaporized working fluid then enters an expansion device (1) in which the vapor is adiabatically expanded to release mechanical energy whereby the temperature and pressure are lowered. The low-temperature and low-pressure working fluid resulting from the working in the expansion device (1) is then sent to a condenser (2) in the form of a heat exchanger where it is cooled by a cold heat source such as cold water to liquefy or condense. The liquefied working fluid is pressurized by a pump (3) and the pressurized fluid is sent or returned to the evaporator (4) to repeat the cycle.

As an expansion device for the Rankine cycle system are used, for example, rotating or reciprocating displacement expansion devices and turbine expansion devices. As an evaporator for the system are used boilers, which are commonly used to produce water-steam. Illustrative of useful condensers are those of the types as used in refrigerating apparatus. Employable as the pump are pressurizing liquid feed pumps for organic solvent generally used in chemical industries.

Present invention provides a novel working fluid which can be utilized especially at an elevated temperature between about 140° to about 200° C. In other words, the working fluid of the invention comprising **R-123*a* is thermally stable at high temperatures and exhibits an improved power output in comparison with a conventional working fluid comprising R-123**.

The working fluid of the invention is expected to exert little influence on the ozone layer if released into the atmosphere, thus eliminating possibility of depletion of the stratopheric ozone layer which is currently a serious global issue.

The working fluid of the invention is nonflammable and is free of fire hazard.

The invention will be described below in more detail with reference to example and comparison example.

EXAMPLE 1 AND COMPARISON EXAMPLE 1

The Rankine cycle illustrated in FIG. 1 was carried out with the use of **R-123*a* (Example 1) and R-123** (Comparison Example 1).

Conditions employed are as follows and the results obtained are given in Tables 1 through 4.

1. Hot water conditions
1500 ton/hr at 140° C., 160° C., 180° C. or 200° C.
2. Cold water conditions
Temperature at inlet: 14.5° C.
Temperature at outlet: 26.0° C.
3. Heat exchanger conditions
Pinch temperature at evaporator: 3° C.
Pinch temperature at condenser: 3° C.

TABLE 1

| Temperature of hot water: 140° C. | R-123a | R-123 |
|---|---|---|
| Gross power output (kW) | 13,004 | 13,080 |
| Net power output (kW) | 10,435 | 10,482 |
| Flow rate of working fluid (ton/hr) | 2,161 | 2,166 |
| Pump power for working fluid (kW) | 547 | 566 |
| Pump power for cooling water (kW) | 1,114 | 1,121 |
| Adiabatic enthalpy drop (kcal/kg) | 5.31 | 5.34 |

TABLE 2

| Temperature of hot water: 160° C. | R-123a | R-123 |
|---|---|---|
| Gross power output (kW) | 18,965 | 19,129 |
| Net power output (kW) | 15,675 | 15,780 |
| Flow rate of working fluid (ton/hr) | 2,560 | 2,576 |
| Pump power for working fluid (kW) | 821 | 857 |
| Pump power for cooling water (kW) | 1,344 | 1,356 |

TABLE 2-continued

| Temperature of hot water: 160° C. | R-123a | R-123 |
|---|---|---|
| Adiabatic enthalpy drop (kcal/kg) | 6.54 | 6.55 |

TABLE 3

| Temperature of hot water: 180° C. | R-123a | R-123 |
|---|---|---|
| Gross power output (kW) | 26,761 | 25,942 |
| Net power output (kW) | 22,378 | 21,541 |
| Flow rate of working fluid (ton/hr) | 3,229 | 3,297 |
| Pump power for working fluid (kW) | 1,208 | 1,183 |
| Pump power for cooling water (kW) | 1,714 | 1,743 |
| Adiabatic enthalpy drop (kcal/kg) | 7.31 | 6.94 |

TABLE 4

| Temperature of hot water: 200° C. | R-123a | R-123 |
|---|---|---|
| Gross power output (kW) | 36,465 | 30,882 |
| Net power output (kW) | 30,833 | 25,654 |
| Flow rate of working fluid (ton/hr) | 3,682 | 3,932 |
| Pump power for working fluid (kW) | 1,885 | 1,402 |
| Pump power for cooling water (kW) | 1,995 | 2,072 |
| Adiabatic enthalpy drop (kcal/kg) | 8.73 | 6.94 |

Figure 2:
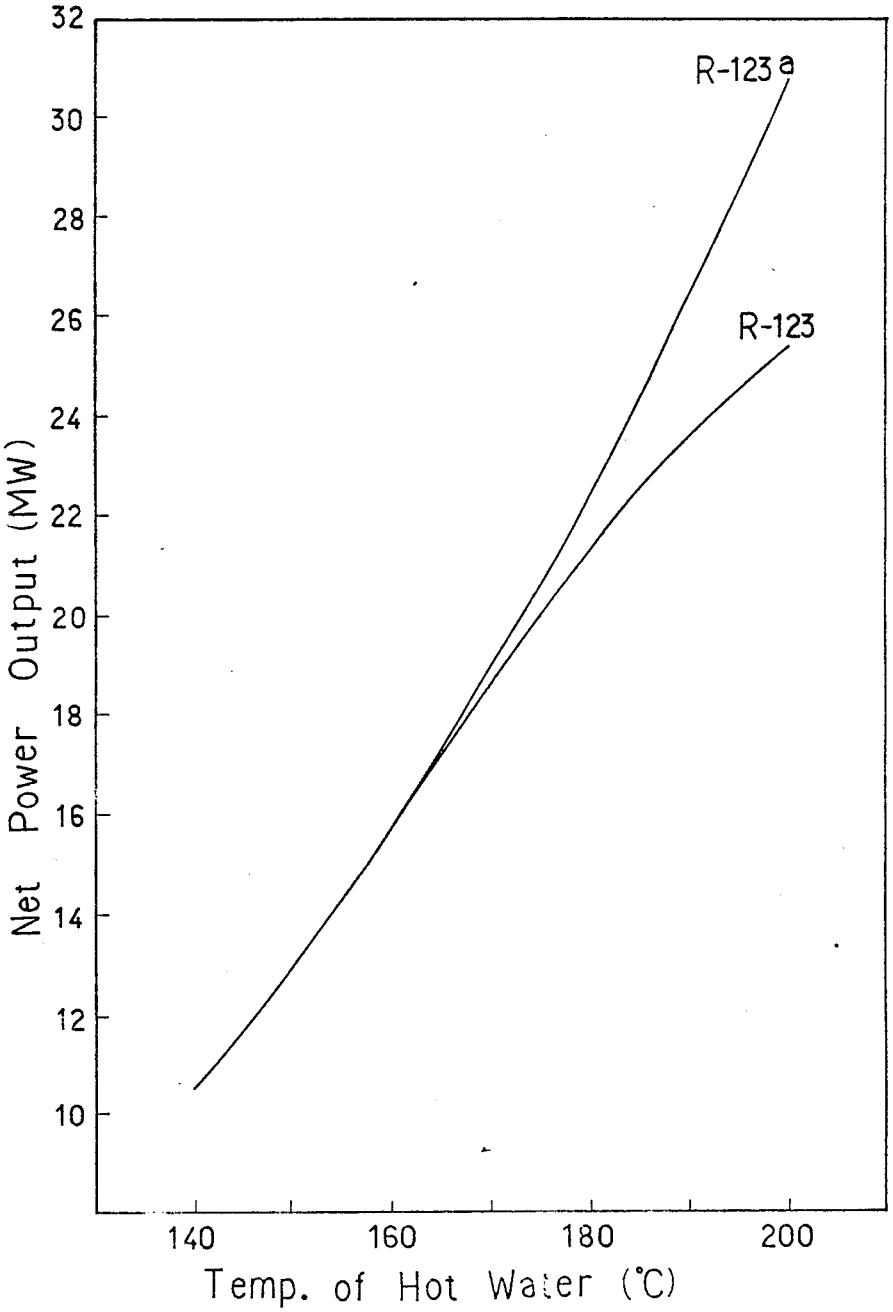
FIG. 2 are graphs each illustrating the performance of **R-123*a* and R-123** in the Rankine cycle using a high-temperature heat source.

FIG. 2 indicates graphs each illustrating the relationship between the temperature of hot water and the power at transmitting end with the use of R-123*a* and R-123, respectively.

Tables 1 through 4 and FIG. 2 reveal that the working fluid of the invention comprising R-123*a* has outstanding properties at high temperatures, especially at temperatures higher than 170° C.

EXAMPLE 2 AND COMPARISON EXAMPLE 2

In a glass tube were sealed (I) a mixture of R-123*a* (5 g) and turbine oil (40 g) or (II) a mixture of R-123 (5 g) and turbine oil (40 g) and a steel piece (2 mm×5 mm×50 mm). The sealed tube was heated (A) at 130° C. for 30 days or (B) at 150° C. for 30 days and then the mixtures were checked for the concentration of halogen and amount of decomposition product.

The results are given in Table 5 below.

TABLE 5

| | Conc. of halogen (ppm) | Decomposition product (%) |
|---|---|---|
| <Condition A> | | |
| Mixture I | 10 | 0.0 |
| Mixture II | 1100 | 1.2 |
| <Condition B> | | |
| Mixture I | 22 | 0.1 |
| Mixture II | 2800 | 1.5 |

Table 5 reveals that the working fluid of the invention comprising R-123*a* has an extremely high thermal stability at elevated temperatures.

What is claimed:

1. A process for converting thermal energy into mechanical energy in the Rankine cycle in which a cycle is repeated comprising the steps of vaporizing a working fluid comprising 1,2-dichloro-1,1,2-trifluoroethane with a hot heat source, expanding the resultant vapor in an expansion device, cooling it with a cold heat source to condense and compressing it by a pump.

* * * * *